US005396776A

United States Patent [19]

Kim

[11] Patent Number: 5,396,776

[45] Date of Patent: Mar. 14, 1995

[54] DUAL-PURPOSE COOLING/HEATING AIR CONDITIONER AND CONTROL METHOD THEREOF

[75] Inventor: Jong-Youb Kim, Suwon, Rep. of Korea

[73] Assignee: Samsung Electronics Co., Ltd., Suwon, Rep. of Korea

[21] Appl. No.: 134,684

[22] Filed: Oct. 12, 1993

[30] Foreign Application Priority Data

Oct. 22, 1992 [KR] Rep. of Korea ..... 92-19451

[51] Int. Cl.[6] ..... F25B 1/00

[52] U.S. Cl. ..... 62/115; 62/132; 62/503

[58] Field of Search ..... 62/160, 503, 132, 115; 237/2 B; 165/29

[56] References Cited

U.S. PATENT DOCUMENTS

| | | | |
|---|---|---|---|
| 3,071,935 | 1/1963 | Kapeker | 62/503 X |
| 3,938,349 | 2/1976 | Ueno | 62/503 X |
| 4,217,765 | 8/1980 | Ecker | 62/503 |
| 4,720,980 | 1/1988 | Howland . | |

*Primary Examiner*—William E. Wayner

*Attorney, Agent, or Firm*—Burns, Doane, Swecker & Mathis

[57] ABSTRACT

In a dual-purpose cooling/heating air conditioner, refrigerant is conducted from an evaporator to an accumulator and then into a compressor. The accumulator includes an electric heater for heating the refrigerant to a desired minimum superheat level in order to promote the evaporation of liquid refrigerant.

20 Claims, 8 Drawing Sheets

DUAL-PURPOSE COOLING/HEATING AIR CONDITIONER AND CONTROL METHOD THEREOF

BACKGROUND OF THE INVENTION

1. Field of the Invention

The present invention relates to an air conditioner, and more particularly to a dual-purpose cooling/heating air conditioner and to a control method thereof for maintaining a degree of refrigerant superheat at an appropriate value to thereby increase the heating efficiency and to prevent the refrigerant compressor from being damaged as well.

2. Description of the Prior Art

FIG. 1 is a schematic diagram of a typical conventional dual-purpose cooling/heating air conditioner for illustrating a refrigerant cycle thereof.

In FIG. 1, during a heating cycle the high-temperature and high-pressure refrigerant compressed by a compressor 1 is infused into an indoor heat exchanger 4 through a four-way valve 10.

The high-temperature and high-pressure refrigerant infused into the indoor heat exchanger 4 emits heat into the indoors by way of an indoor fan 12 to thereby become condensed.

The refrigerant condensed by the indoor heat exchanger 4 becomes saturated under low pressure by means of passing through a pressure reducer 3 and is discharged from the pressure reducer.

The refrigerant discharged by the pressure reducer 3 is infused into an outdoor heat exchanger 2 and absorbs ambient heat from the outdoors by way of an outdoor fan 11 to thereby become evaporated.

The refrigerant evaporated by the outdoor heat exchanger 2 is infused into an accumulator 5 through the four-way valve 10.

The accumulator 5 prevents liquid refrigerant from being infused into the compressor 1, to thereby infuse only the evaporated refrigerant into the compressor 1.

Meanwhile, a reverse cycle of the aforesaid sequence is performed during a cooling and de-frosting operation.

The four-way valve 10 sends the refrigerant coming from the compressor 1 to the indoor heat exchanger 4 during the heating operation, and sends the same to the outdoor heat exchanger 3 during the cooling or de-frosting operation.

Furthermore, reference numeral 13 designates a non-return valve for passing the refrigerant during the cooling operation and for not passing the refrigerant during the heating operation.

FIG. 2 is a diagram plotting compressor speed in revolutions per minute (rpm) against the open air temperature in a conventional dual-purpose cooling/heating air conditioner.

When the open air temperature is below Ta(approximately 3 degrees below zero celsius, which is the open air temperature where the heating capacity and heating load coincide when the compressor is operated at maximum speed) during the heating, the compressor 1 is operated at the maximum speed while, when the open air temperature is above Tr(approximately) 25 degrees celsius, which is the open air temperature where the operation of the compressor is unnecessary), the operation of the compressor is stopped.

FIG. 3 is a diagram plotting heating capacity and heating load against the open air temperature in a conventional dual-purpose cooling/heating air conditioner.

In FIG. 3, it should be noted that the lower the open air temperature, the heavier the heating load, and the higher the open air temperature, the more increased is the heating capacity in relation to the revolution speed of the compressor.

In other words, when the open air temperature is above Tr(approximately 21 degrees celsius), the indoor temperature can be increased to a temperature a user wants even though the revolution speed of the compressor is minimized.

If the open air temperature is above To(approximately 7 degrees celsius), the indoor temperature can be increased to a temperature the user wants with the revolution speed of the compressor at a rated speed.

If the open air temperature is above Ta, the revolution speed of the compressor is increased to the maximum to thereby make the indoor temperature reach a temperature the user wants. However, if the open air temperature is below Ta, the indoor temperature can not be increased to a temperature the user wants even though the revolution speed of the compressor is maximized, where, the open air temperatures Ta, To, Tr have the relations of $Ta<To<Tr$.

As described above, in the conventional dual-purpose cooling/heating air conditioner there has been a problem in that the indoors can not be heated up to a temperature the user wants even though the compressor is operated at the maximum speed due to lack of a sufficient heat source at low outdoor temperature.

FIG. 4 is a pressure(p)-enthalpy(h) curve diagram of a conventional dual-purpose cooling/heating air conditioner.

In other words, if a refrigerant having T2 as a suction temperature at the compressor inlet is compressed, the enthalpy is increased to thereby make the refrigerant discharge temperature at the compressor outlet reach T1.

The refrigerant discharged from the compressor 1 which is in an evaporated state at T1 enters the indoor heat exchanger 4 (or condenser) to thereafter emit heat into the indoors, and the refrigerant thereby becomes condensed into a liquid state and discharged. The refrigerant becomes low in pressure at the pressure reducer 3 (or expansion apparatus) to thereafter be discharged in a mixed state of liquid and gas.

The refrigerant discharged from the pressure reducer 3 absorbs heat from the outdoor heat exchanger 2 and becomes gaseous when the absorption temperature of the refrigerant at the compressor inlet reaches T2.

However, if the refrigerant does not absorb enough heat from the outdoor heat exchanger 2 so that the temperature of the refrigerant remains below a saturated temperature Ts, the refrigerant to be infused into the compressor 1 is in the mixed state of gas and liquid.

At this moment, if the liquidized refrigerant is infused into the compressor 1, there arises a phenomenon where incompressible liquid changes into gas instantly when compressed, so that the refrigerant gets increased in volume to thereby cause damage to vanes and rollers comprising the compressor.

Accordingly, it is a role of the accumulator 5 to prevent the liquid refrigerant from being infused into the compressor 1 and to infuse only the evaporated refrigerant into the compressor 1.

At this location, a section from Ts to T2 is called a degree of superheat (SHs; see FIG. 4) and the ideal degree of superheat (SHs=T2–Ts) in the conventional dual-purpose cooling/heating air conditioner is approximately 6 degrees celsius.

However, because the conventional dual-purpose cooling/heating air conditioner has lacked in the degree of superheat due to want of a heat source at a low outdoor temperature, the refrigerant can not be evaporated fully within the outdoor heat exchanger 2, so that the refrigerant in the mixed state of liquid and gas has been infused into the accumulator 5.

If the mixed refrigerant of liquid and gas is infused into the accumulator 5, the accumulator 5 discharges only the gaseous refrigerant to the compressor 1 and the liquid refrigerant remains to thereby be accumulated.

If the liquidized refrigerant is accumulated in the accumulator 5, there occurs a phenomenon where the liquidized refrigerant and its lubricating oil are separated at a border to thereby cause the compressor 1 to operate improperly.

In other words, in order to operate the compressor 1 smoothly, oil is injected into the compressor 1 and part of the oil is discharged with the refrigerant.

If the liquidized refrigerant is accumulated in the accumulator 5, the oil is not retrieved into the compressor 1.

As seen from the foregoing, the conventional dual-purpose heating/heating air conditioner has a problem in that it has deteriorated cooling capacity due to lack of a heat source at low outdoor temperature (open air temperature) and the refrigerant is not fully evaporated to thereby cause the compressor to become damaged.

SUMMARY OF THE INVENTION

Accordingly, it is an object of the present invention to increase a heating efficiency by supplying heat to the refrigerant to thereby maintain a degree of superheat when the open air temperature is low.

It is another object of the present invention to enhance an oil retrieval into the compressor by maintaining the degree of superheat properly to thereby prevent an accumulation of liquidized refrigerant and oil in the accumulator.

It is still another object of the present invention to improve the heating efficiency by detecting the temperature and pressure of the refrigerant being drawn into the compressor and the temperature and pressure of the discharged refrigerant to thereby control a heater and a compressor.

It is still another object of the present invention to perform a de-frosting operation quickly by driving the heater during the de-frosting operation.

In accordance with one aspect of the present invention, there is provided a dual-purpose cooling/heating air conditioner comprising: a supplemental heating means for supplementally heating a refrigerant to a degree of superheat before the refrigerant is infused into a compressor; and a control means for controlling the supplemental heating means to thereby maintain a predetermined degree of superheat.

In accordance with another aspect of the present invention, there is provided a control method of a dual-purpose cooling/heating air conditioner, the method comprising: a first step for calculating a degree of superheat of the refrigerant being infused into the compressor; and a second step for supplementally heating the refrigerant in accordance with the degree of superheat calculated from the first step to thereby maintain a predetermined degree of superheat.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Next, the present invention will be described in detail with reference to the accompanying drawings.

Figure 1:
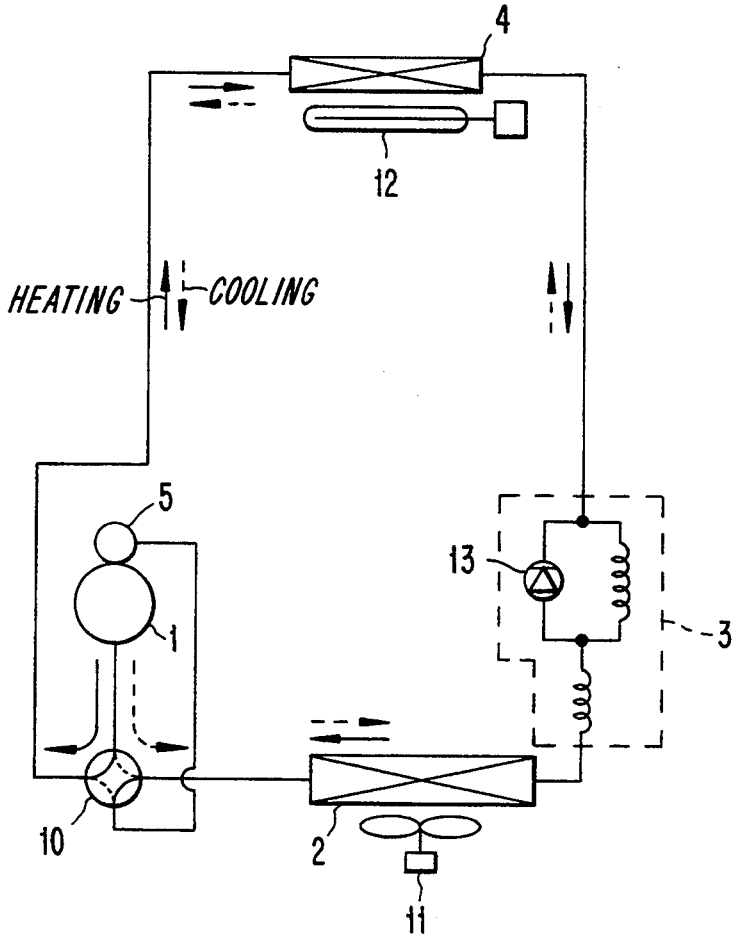
FIG. 1 (PRIOR ART)
FIG. 1 is a schematic diagram for illustrating a refrigerant cycle of a typical conventional dual-purpose cooling/heating air conditioner.
Figure 2:
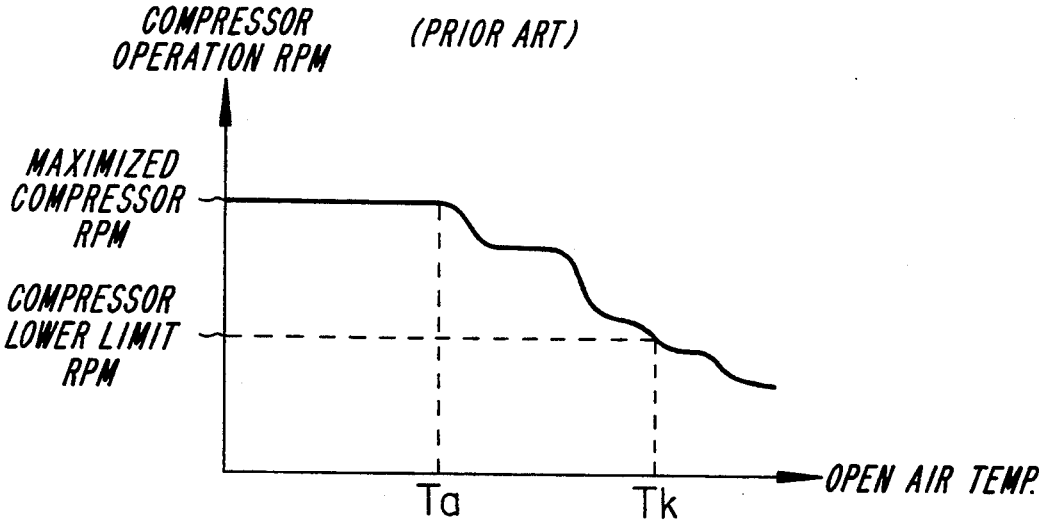
FIG. 2 (PRIOR ART)
FIG. 2 is a diagram plotting compressor speed against the open air temperature in a conventional dual-purpose cooling/heating air conditioner.
Figure 5:
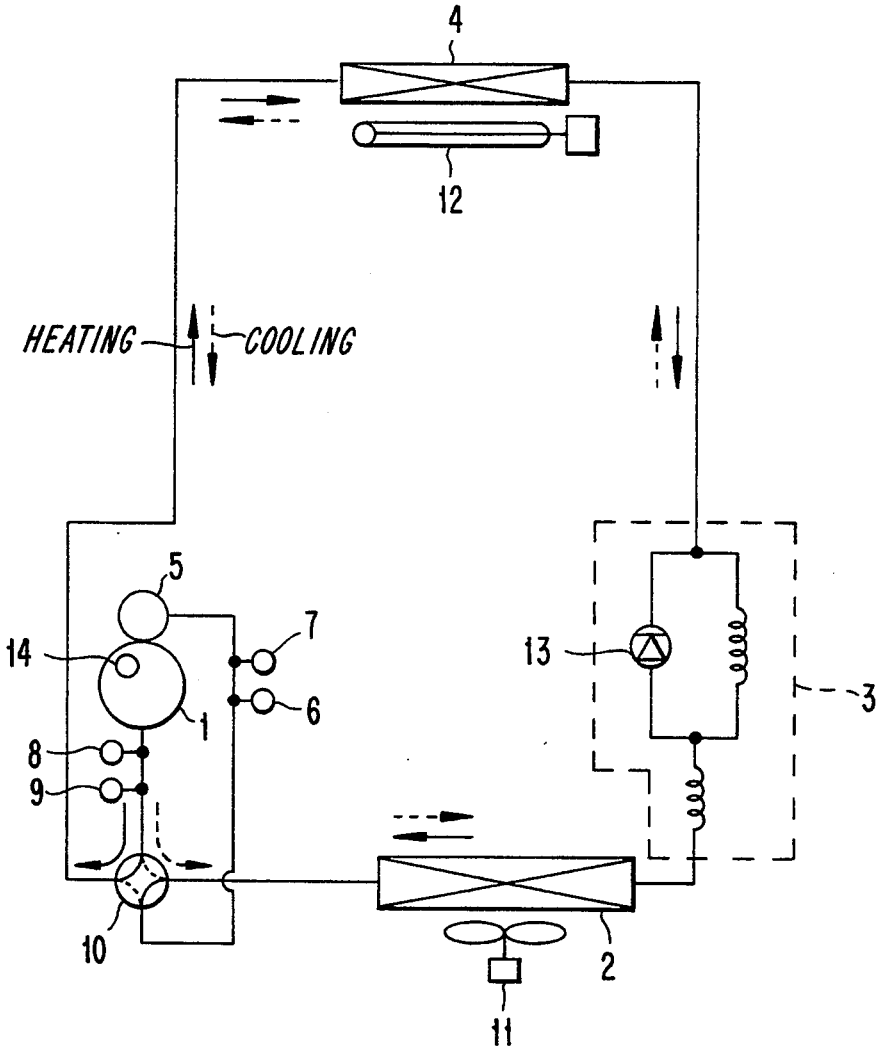
FIG. 5 is a schematic diagram for illustrating a refrigerant cycle of an embodiment of a dual-purpose cooling/heating air conditioner in accordance with the present invention.

FIG. 5 is a schematic diagram for illustrating a refrigerant cycle of a dual-purpose cooling/heating air conditioner whereby elements corresponding to those of FIG. 1 are designated with like reference numerals.

In FIG. 5, the high-temperature and high-pressure refrigerant compressed by the compressor 1 is infused into the indoor heat exchanger 4 through the four-way valve 10.

The high-temperature and high-pressure refrigerant infused into the indoor heat exchanger 4 emits heat into the indoors by way of the indoor fan 12 to thereafter become condensed into liquid.

The refrigerant condensed at the indoor heat exchanger 4 becomes saturated under low pressure at the pressure reducer 3 and then is discharged.

The refrigerant discharged from the pressure reducer 3 is infused into the outdoor heat exchanger 2 and is evaporated by heat supplied thereto through the agency of the outdoor fan 11, absorbing heat from the outside.

The refrigerant evaporated in the outdoor heat exchanger 2 is infused into the accumulator 5 through the four-way valve 10.

The accumulator 5 prevents liquid refrigerant from being infused into the compressor 1 and in turn infuses only evaporated refrigerant into the compressor 1.

During the cooling and de-frosting operations, a reverse cycle from the aforesaid is performed.

The four-way valve 10 supplies the refrigerant discharged from the compressor 1 to the indoor heat exchanger 4 during the heating operation, and supplies the refrigerant to the outdoor heat exchanger 2 during the cooling and de-frosting operations.

Furthermore, reference numeral 13 designates a non-return valve which lets the refrigerant pass through during the cooling operation but does not let the refrigerant pass through during the heating operation.

The aforementioned sequences are the same as those of the prior art described in connection with FIG. 1.

Meanwhile, a heater, which is a supplementary heating means for supplementally heating the refrigerant before being infused into the compressor 1 is installed within the accumulator 5 and is controlled by a control means to thereby maintain a predetermined degree of superheat(SHs).

In other words, if the degree of superheat SHs is low, the control means drives the heater to increase the degree of superheat SHs.

The degree of superheat SHs is calculated from the temperature and pressure of the refrigerant infused into the compressor 1.

Accordingly, the control means detects a suction temperature T2 and a suction pressure P2 of the refrigerant infused into the compressor 1 by way of a suction temperature detector 6 and a suction pressure detector 7 disposed between the four-way valve 10 and the accumulator 5.

The control means calculates a saturated temperature Ts on the basis of the suction pressure P2 detected by the suction pressure detector 7.

The control means can calculates the saturated temperature Ts by selecting the temperature Ts from a look-up table, Table 1, which is derived empirically.

TABLE 1

A look-up table for illustrating a saturated temperature against the suction pressure.

| suction pressure (P2) [MPA] | saturated temperature (Ts) [°C.] |
|---|---|
| — | — |
| — | — |
| 0.60254 | 6 |
| 0.64083 | 8 |
| 0.68091 | 10 |
| — | — |
| — | — |

Then, the control means uses the saturated temperature Ts as a reference temperature and calculates the level or degree of superheat SHs from the detected suction temperature T2 and the saturated temperature Ts based on the following formula 1.

$$SHs = T2 - Ts \qquad \text{(Formula 1)}$$

If the degree of superheat SHs calculated by the formula is below a predetermined value (approximately 6 degrees celsius), the control means drives the heater disposed in the accumulator 5 to thereby supplementally heat the refrigerant.

Therefore, because the refrigerant maintains a sufficient degree of superheat to thereby be evaporated completely, the liquidized refrigerant is not accumulated in the accumulator 5, so that the oil for the compressor is smoothly retrieved and the compressor is prevented from being damaged.

Figure 3:
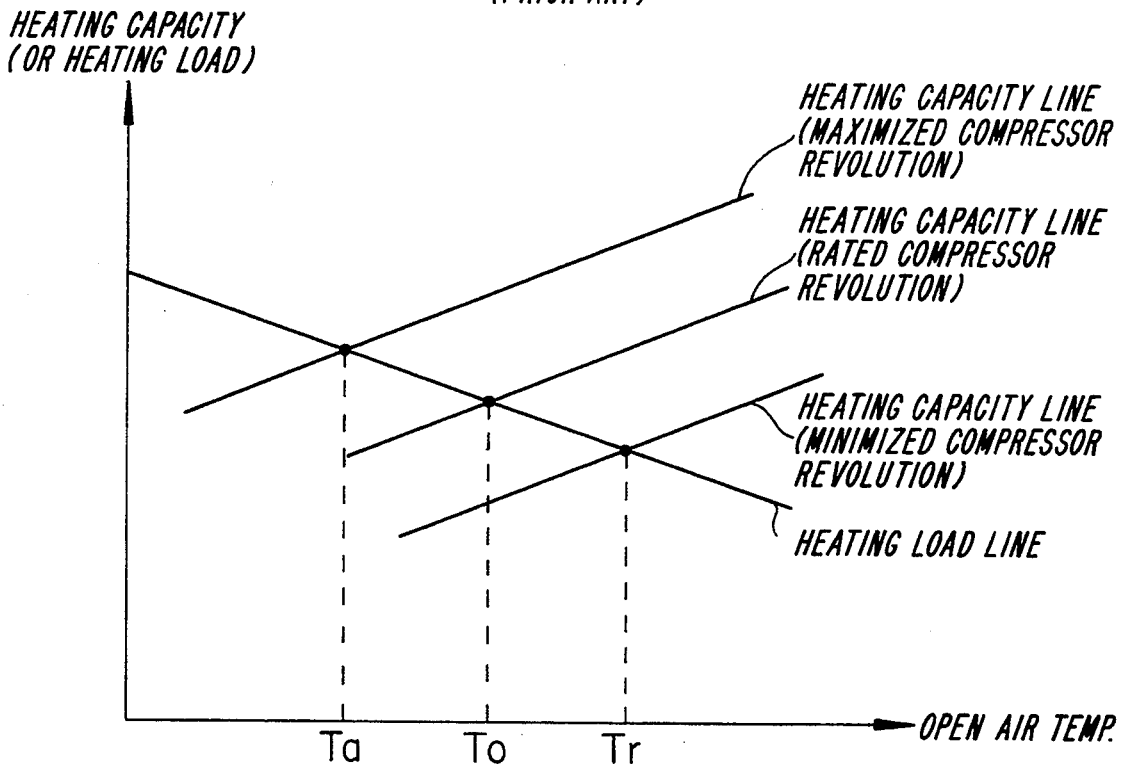
FIG. 3 (PRIOR ART)
FIG. 3 is a diagram plotting heating capacity and heating load against the open air temperature in a conventional dual-purpose cooling/heating air conditioner.
Figure 4:
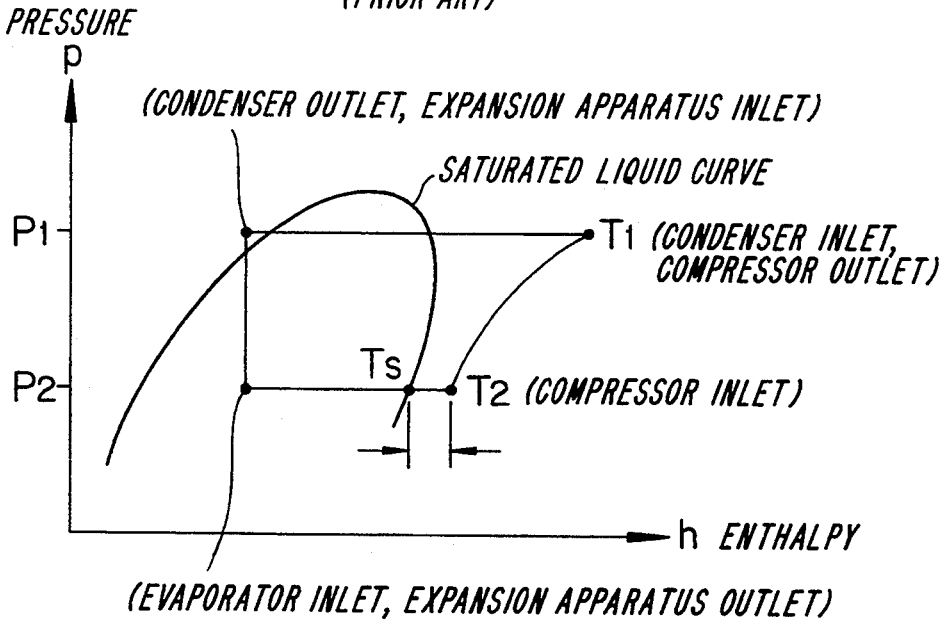
FIG. 4 (PRIOR ART)
FIG. 4 is a pressure-enthalpy curve diagram for a conventional dual-purpose cooling/heating air conditioner.

Furthermore, the control means drives the compressor 1 at the maximum speed if the outdoor temperature detected by an outdoor temperature detector is below Ta(approximately 3 degrees below zero celsius, which is the outdoor temperature at a point where the heating capacity and heating load are correspondent during an operation of the compressor at maximum speed; see FIG. 3) and at the same time, the control means drives at a maximum the heater installed within the accumulator 5 to thereby increase the heating capacity.

At this point, if the temperature T2 detected by the suction temperature detector 6 is higher than the temperature Tb (approximately 10 degrees below zero celsius) established for protection of the compressor 1, the control means discriminates whether an overload protection temperature OLP, discharging temperature T1 and discharging pressure P1 are respectively larger than a threshold value T0c of the compressor overload protection temperature, a threshold value T1c (approximately 125 degrees celsius)of the discharging temperature and a threshold value P1C (approximately 26.5 kg/cm$^2$) of the discharging pressure, and controls the compressor 1 in accordance with the discriminated result thereof.

In other words, the control means de-activates the compressor 1 if the suction tempreature T2 is higher than the established temperature Tb in order to protect the compressor 1, or if the discharging temperature T1 detected by a discharging temperature dectctor 8 is higher than the threshold value T1c of the discharging temperature for protection of the compressor.

Furthermore, the control means de-activates the compressor 1 if the suction temperature T2 is higher than the established temperature Tb to protect the compressor 1 or if the discharging pressure P1 detected by a discharging pressure detecter 9 is larger than the threshold value P1C of the discharging pressure for compressor protection.

Still furthermore, the control means de-activates the compressor 1 if the temperature for overload protection OLP detected by a temperature sensor for overload protection 14 is higher than the threshold value for overload protection temperature T0c in the compressor, or if the suction temperature T2 is higher than the established temperature Tb in order to protect the compressor 1.

Meanwhile, the heater is driven even during the initial operation (approximately 5 minutes) to supplement the heat, so that the established temperature can be quickly reached and the liquid refrigerant can also be prevented from entering into the compressor 1.

Furthermore, the heater is driven even during the de-frosting (i.e., the cooling cycle) to thereby achieve a quick de-frosting.

Figure 6:
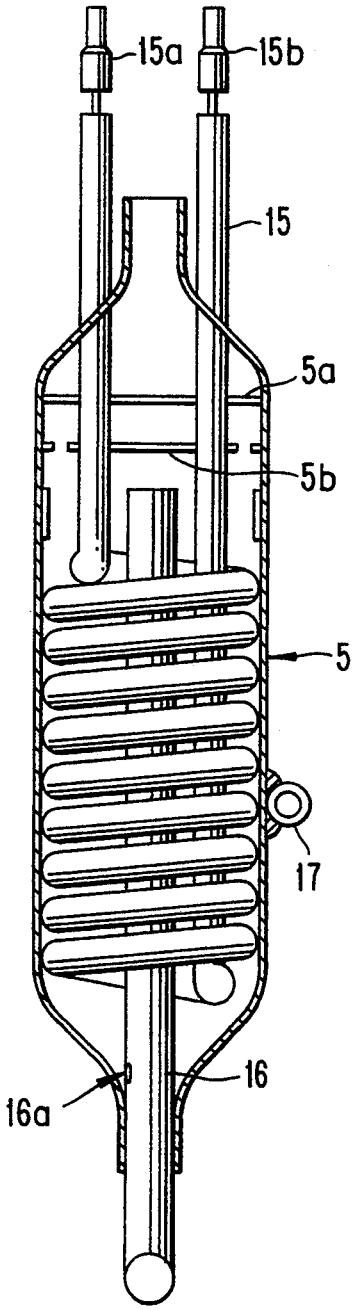
FIG. 6 is a schematic sectional drawing for illustrating an embodiment of an accumulator according to the present invention.

FIG. 6 is a schematic sectional drawing for illustrating an embodiment of an accumulator according to the present invention.

In FIG. 6, a standpipe 16 is disposed centrally within the accumulator 5, and a mesh 5*a* and a baffle plate 5*b* are installed in an upper area of the accumulator 5.

The heater 15 is formed in a coil shape disposed around the standpipe 16 in order to maximize a length of the coil.

Accordingly, a heating surface of the coil is made large to thereby obtain a maximized thermal efficiency.

In FIG. 6, reference numerals 15*a* and 15*b* designate terminals by which electrical power is supplied to the heater 15.

Reference numeral 16a designates an oil return hole for retrieving the oil for the compressor.

Reference numeral 17 designates a temperature sensor for cutting off the power supplied to the heater 15 if the accumulator 5 is overheated by the heater 15.

Therefore, if the refrigerant evaporated by the outdoor heat exchanger 2 is infused into the inlet of the accumulator 5 through the four-way valve 10 during the heating operation, the gas component of the refrigerant is infused into the standpipe 16 through the mesh 5a and the baffle plate 5b.

The mesh 5a and the baffle plate 5b are formed with holes not aligned with the standpipe 16, so that the liquid refrigerant which has not been evaporated due to the lack of the degree of superheat SHs flows into the bottom of the accumulator 5.

Meanwhile the control means drives the heater 15 if the degree of superheat SHs is insufficient, and if the heater 15 is driven, the accumulated liquid refrigerant.

The evaporated refrigerant is infused into the compressor 1 through the standpipe 16.

The oil flowing into the bottom of the accumulator 5 is infused into the compressor 1 through the oil return hole 16a by the gas stream within the standpipe 16.

The heater 15 is operated even during the initial operation to evaporate the liquid refrigerant infused into the accumulator 5.

Figure 7:
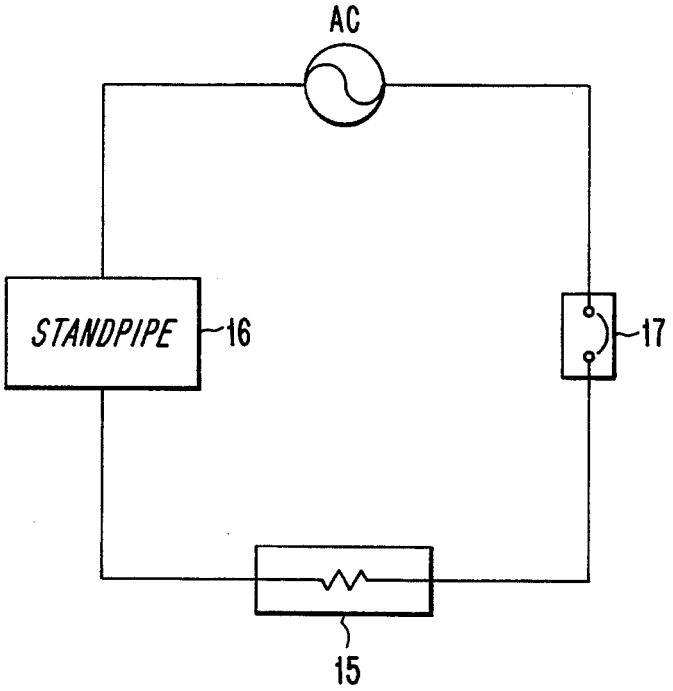
FIG. 7 is a control circuit diagram of a heater utilized for the present invention.
Figure 8:
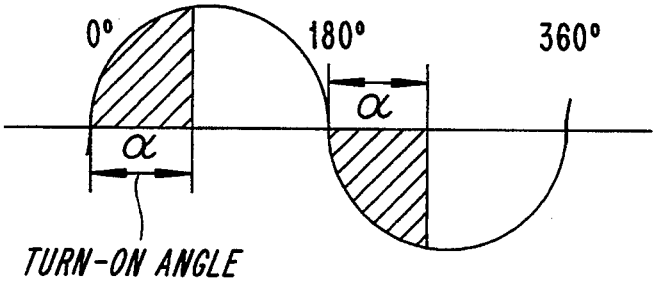
FIG. 8 is an embodiment of a voltage waveform supplied to the heater in FIG. 7.

FIG. 7 is a control circuit diagram of a heater utilized for the present invention, and FIG. 8 is a diagram of voltage waveform supplied to the heater in FIG. 6 or FIG. 7.

In other words, if the calculated degree of superheat SHs is below the predetermined value (approximately 6 degrees celsius), the control means controls a heater driving unit 24 (to be explained in reference to FIG. 9), and drives the heater 15 installed in the accumulator 5 to thereby supplement the heat source.

In other words, the control means, as explained in the aforesaid, calculates a turn-on angle(a) in accordance with the calculated degree of superheat SHs to thereby control the heater driving unit 24 and maintain a predetermined degree of superheat.

A temperature sensor cutoff switch 17 is installed on an exterior of the accumulator 5 (see FIG. 6) to cut off the power supplied to the heater 15 if the accumulator 5 is overheated by the heater 15.

Figure 9:
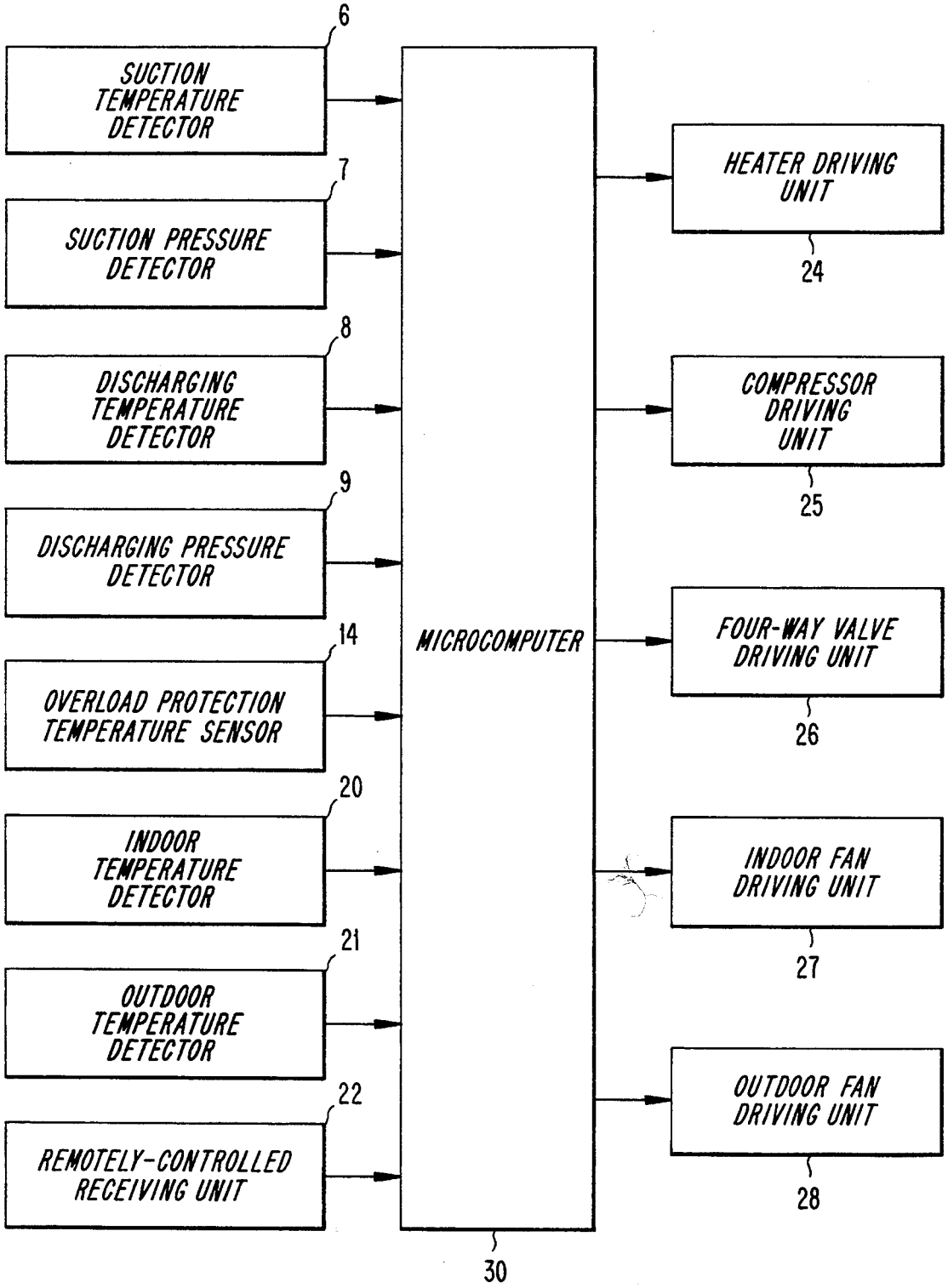
FIG. 9 is a block diagram of a control means in a dual-purpose cooling/heating air conditioner according to the present invention.

FIG. 9 is a block diagram of the control means in a dual-purpose cooling/heating air conditioner according to the present invention.

In FIG. 9, reference numeral 6 designates the suction temperature detector for detecting the temperature T2 of the refrigerant infused into the accumulator 5 (see FIG. 5).

Reference numeral 7 designates the suction pressure detector for detecting the pressure P2 of the refrigerant infused into the accumulator 5.

Reference numeral 8 designates the discharging temperature detector for detecting the temperature T1 of the refrigerant discharged from the compressor 1 (see FIG. 5).

Reference numeral 9 designates the discharging pressure detector for detecting the pressure P1 of the refrigerant discharged from the compressor 1, and reference numeral 14 designates the temperature sensor for overload protection for detecting the temperature of the compressor 1 rising due to an overload.

Reference numeral 20 designates an indoor temperature detector for detecting the indoor temperature, reference numeral 21 designates an outdoor temperature detector for detecting the outdoor temperature, and reference numeral 22 designates remotely controlled receiving unit for inputting a key signal in accordance with the user's operation and for receiving the signal inputted from the remotely controlled receiving unit.

Reference numeral 30 designates a microcomputer which outputs various information in accordance with the input signals supplied from suction temperature detector 6, suction pressure detector 7, discharging temperature detector 8, discharging pressure detector 9, temperature sensor for overload protection 14, indoor temperature detector 20, outdoor temperature detector 21 and the remotely controlled receiving unit 22, so that the dual-purpose cooling/heating air conditioner in accordance with the present invention can be controlled.

Reference numeral 24 designates a heater driving unit for being operated by the control signal outputted from the microcomputer 30 and for controlling the driving of the heater 15 as illustrated in FIG. 6 or FIG. 7.

Reference numeral 25 designates a compressor driving unit for being operated by the control signal outputted from the microcomputer 30 and for controlling the driving of the compressor 1 as illustrated in FIG. 5.

Reference numeral 26 designates a four-way valve driving unit for being controlled by the microcomputer 30 and for driving the four-way valve 10 (see FIG. 5) in accordance with the cooling or heating (or de-frosting) operation to thereby cause the refrigerant discharged from the compressor 1 to be discharged to the indoor heat exchanger 4 or outdoor heat exchanger 2.

Reference numeral 27 designates an indoor fan driving unit for being controlled by the microcomputer 30 and for driving the indoor fan 12. (see FIG. 5)

Reference numeral 28 designates an outdoor fan driving unit for being controlled by the microcomputer 30 to thereby drive the outdoor fan 11. (see FIG. 5)

Figure 10A:
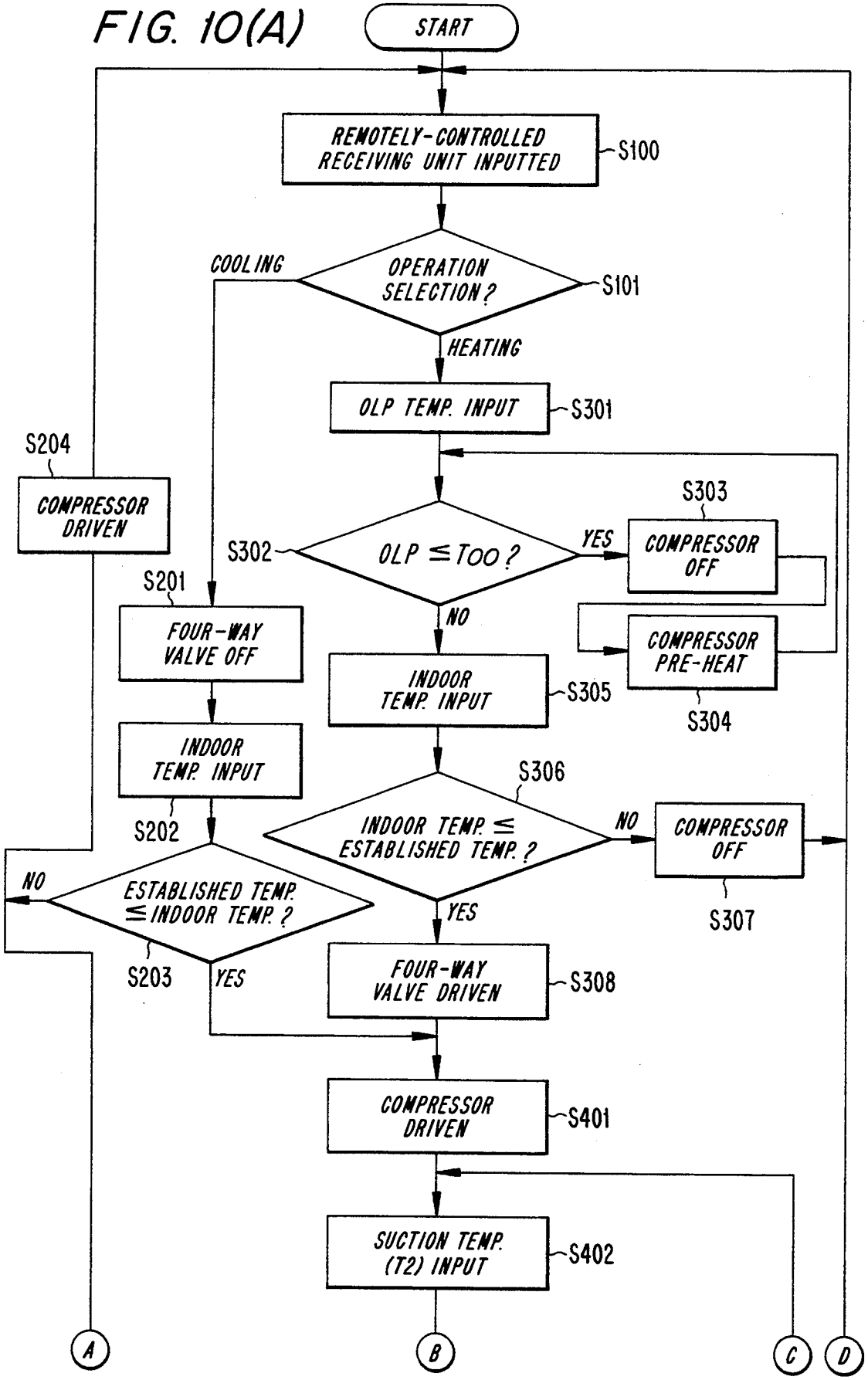
FIGS. 10 (A), (B) and (C) are flow charts for illustrating a control method of a dual-purpose cooling/heating air conditioner according to the present invention.
Figure 10B:
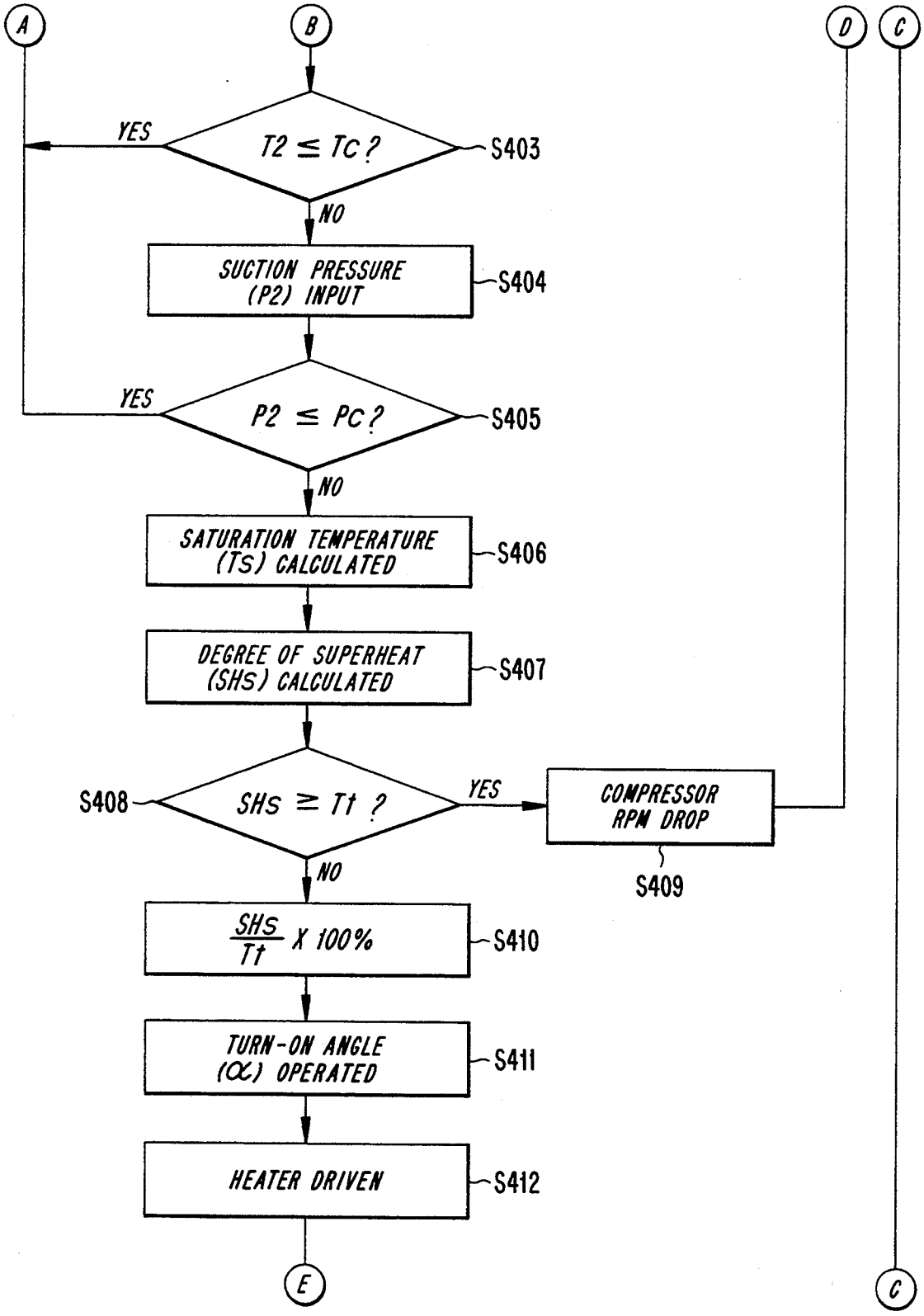
Figure 10C:
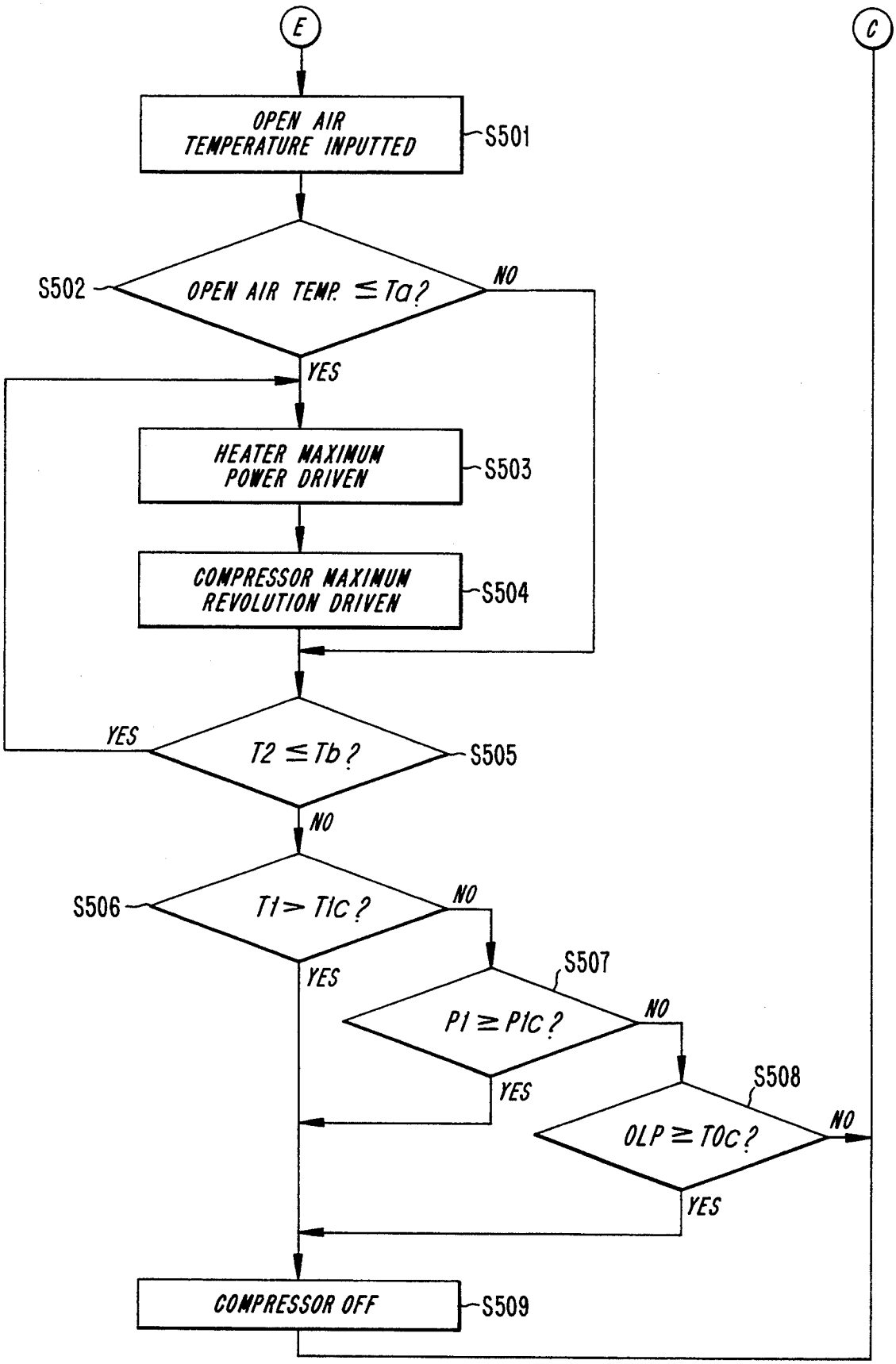

FIGS. 10A–10C are flow charts for illustrating a control method of a dual-purpose cooling/heating air conditioner according to the present invention, the method of which is controlled by the control means as illustrated in FIG. 9.

According to FIGS. 10A–10C, the control method of a dual-purpose cooling/heating air conditioner comprises: a first step for calculating a degree of superheat (SHs) of the refrigerant infused into the compressor; and a second step for supplementing heat to the refrigerant in accordance with the degree of superheat calculated from the first step to thereby maintain a predetermined degree of superheat (SHs).

Next, an operational sequence of the control method will be described in detail with reference to FIGS. 10A–10C.

First of all, the microcomputer receives a signal on the user's operation through the remotely controlled receiving unit 22 at step S100.

If it is determined that an operational mode is a cooling operation by the signal inputted through the remotely controlled receiving unit 22 at step S101, the microcomputer 30 advances to step S201 to thereby drive the four-way valve driving unit 26, so that the four-way valve 10 can be controlled in order for the refrigerant coming out of the compressor 1 to be discharged to the outdoor heat exchanger 2.

Then, flow proceeds to step S202 to input the indoor temperature detected by the indoor temperature detector 20 and compares the same with the temperature established by the user at step S203.

As a result of the comparison performed at step S203, if the indoor temperature is lower than the temperature established by the user, a compressor driving unit 25 is controlled at step S204 to de-activate the compressor 1 because there is no need for cooling, and flow advances to step S101 to re-discriminate a state of an operational selection.

However, if, as a result of the comparison at step S203, the indoor temperature is equal to or higher than the temperature established by the user, flow proceeds to step S401 because the cooling operation should be executed, and controls the compressor driving unit 25 to drive the compressor 1.

Meanwhile, if the user selects the heating operation, the microcomputer 30 proceeds from step S101 to step S301 to thereby receive the overload temperature OLP from the temperature sensor for overload protection 14 installed at the compressor 1, and compares the same with a predetermined temperature Too (approximately 5 degrees below zero celsius under a state where the compressor can not be operated because an oil viscosity of the compressor is too high.)

As a result of comparison at step S302, if the overload temperature OLP is lower than the predetermined temperature Too, flow proceeds to step S303 to control the compressor driving unit 25 so that the compressor 1 can be de-activated. At step S304, the power is supplied only to two phases out of three phases (U phase, V phase and W phase) of the compressor 1 to thereby pre-heat the compressor 1.

It is determined that the pre-heating of the compressor 1 is completed, and the compressor 1 should be in an operable state when the overload temperature OLP is determined to be higher than the predetermined temperature Too at step S302.

Accordingly, the indoor temperature is received from the indoor temperature detector 20 at step S305, and at step S306 the indoor temperature is compared with the temperature the user has established.

As a result of the comparison at step S306, if the indoor temperature is equal to or higher than the established temperature, the operational flow advances to step S307 because there is no need for heating operation, to thereby drive the compressor driving unit 25, so that the compressor 1 can be turned off.

Flow now proceeds to step S101 to reevaluate the state of the operational selection.

As a result of comparison at step S306, if the indoor temperature is lower than the established temperature, flow advances to step S308 to thereby drive the four-way valve driving unit 26 because there is a need for heating, so that the four-way valve 10 can be controlled in order for the refrigerant discharged from the compressor 1 to be discharged to the indoor heat exchanger 4, and at step S401, the compressor driving unit 25 is controlled to turn on the compressor 1.

As seen from the foregoing, the microcomputer 30, executing the cooling or heating operation, receives the temperature T2 of the refrigerant infused from the compressor 1 at step S402 through the suction temperature detector 6 and compares the same at step S403 with a predetermined temperature Tc (approximately 40 degrees below zero celsius, an inoperable threshold temperature in the sense of refrigerant characteristic).

As a result of the comparison at step S403, if the temperature T2 of the refrigerant infused into the compressor 1 is lower than the predetrmined temperature Tc, operational flow advances to step S204 because it is impossible to operate in the sense of the refrigerant characteristic, so that the compressor driving unit 25 can be controlled to de-activate the compressor 1.

As a result of the comparison at step S403, if the temperature T2 of the refrigerant infused into the compressor 1 is egual to or higher than the predetermined temperature Tc, flow proceeds to step S404 to receive the pressure P2 of the refrigerant infused into the compressor 1 through the suction pressure detector 7 and compare the same at step S405 with a predetermined pressure Pc (approximately 0.5 kg/cm$^2$, an inoperable threshold pressure in the sense of the refrigerant characteristic).

As a result of the comparison at step S405, if the pressure P2 of the refrigerant infused into the compressor 1 is lower than the predetermined pressure Pc, flow advances to step S204 to control the compressor driving unit 25, so that the compressor 1 can be de-activated because it is impossible to operate due to the characteristic of the refrigerant.

As a result of the comparison at step S405, if the pressure P2 of the refrigerant infused into the compressor 1 is equal to or higher than the predetermined pressure Pc, flow proceeds to step S406 and calculates the saturated temperature Ts from the pressure P2 detected by the suction pressure detector 7 utilizing the look-up table, Table 1, and at step S407, calculates the degree of superheat SHs.

In other words, the degree of superheat ($SHs = T2 - Ts$) is calculated from the aforesaid Table 1.

Then, at step S408, flow determines whether the degree of superheat SHs calculated from the step S407 is equal to or above a predetermined temperature Tt (An approximate degree of superheat is around 6 degrees celsius).

As a result of the comparison at step S407, if the degree of superheat SHs is equal to or above the predetermined temperature Tt, it implies that the heat source is sufficient and the refrigerant is completely in an evaporated gaseous state for a sufficient heating capacity of the compressor 1, and flow advances to step S409 to control the compressor driving unit 25, so that the revolution of the compressor 1 can be decreased.

As a result of the comparison at step S407, if the degree of superheat SHs is below the predetermined temperature Tt, it implies that the heat source is not sufficient, so that the heater driving unit 24 is controlled to thereby supply the power to the heater 15 and to complement the heat source.

In other words, a present degree of superheat SHs calculated by the suction pressure P2 and temperature T2 is calculated (at step S410) by the percentage ($SHs/Tt \times 100\%$) against the predetermined temperature Tt, and an operation is performed on the the turn-on angle a of the power source supplied to the heater 15 in accordance with the percentage calculated at step S411.

The heater driving unit 24 is controlled in accordance with the turn-on angle a operated at step S412 to thereby drive the heater 15.

The microcomputer 30 detects the outdoor temperature by way of the outdoor (open air) temperature detector 21 at step 501 and at step S502, compares the same with a predetermined outdoor temperatue Ta (approximately 3 degrees below zero celsius, an outdoor temperature at a point where the heating capacity and heating load are correspondent during the operation of the compressor at a maximum revolution speed).

Furthermore, the compressor driving unit 25 is controlled at step S504 to thereby drive the revolution speed of the compressor to the maximum, and at step S505 the microcomputer 30 discriminates whether the temperature T2 of the refrigerant detected by the suction temperature detector 6 is lower than the predetermined temperature Tb.

As a result of the comparison at step S505, if the temperature T2 of the refrigerant detected by the suction temperature detector 6 is lower than the predetermined temperature Tb, the microcomputer keeps performing steps S503 and S504, but if the temperature T2 is equal to or higher than the predetermined temperature Tb, the microcomputer 30 performs step S506.

As step S506, the temperature T1 of the refrigerant discharged from the compressor 1 is received through the discharging temperature detector 8 to thereby compare the same with a predetermined temperature T1c (approximately 125 degrees celsius, a threshold value of discharging temperature for compressor protection).

As a result of the comparison at the step S506, if the discharging temperature T1 of the refrigerant is higher than the predetermined temperature T1c, the microcomputer 30 controls the compressor driving unit 25 to de-activate the compressor 1, and if the discharging temperature T1 is lower than the predetermined temperature T1c, the microcomputer performs step S507.

At step S507, the pressure p1 of the refrigerant discharged from the compressor 1 is received through the discharging pressure detector 9 to thereby compare the same with a predetermined pressure P1c (approximately 26.5 kg/cm$^2$; a threshold value of the discharging pressure for compressor protection).

As a result of the comparison at step S507, if the discharging pressure p1 of the refrigerant is equal to or greater than the predetermined pressure P1c, the microcomputer controls the compressor driving unit 25 to de-activate the compressor 1, and if the discharging pressure P1 is less than the predetermined pressure P1c, the microcomputer performs step S508.

At step S508, the overload temperature OLP inputted from the temperature sensor for protection of overload 14 and a predetermined temperature TOC (approximately 129 degrees celsius, a threshold value of overload pretection temperature for compressor protection) are mutually compared.

As a result of the comparison at step S508, if the overload temperature OLP is equal to or higher than the predetermined temperature TOC, the microcomputer controls the compressor driving unit 25 to turn off the compressor 1, and if the overload temperature OLP is lower than the predetermined temperature TOC, flow proceeds to step S101 to reevaluate the operational selection state.

Meanwhile, at the initial operation (heating operation), the heater can be driven for a predetermined period of time to thereby reach an established temperature, and at the same time, the refrigerant within the accumulator 5 is made to evaporate fully, so that inflow of the liquid refrigerant into the compressor 1 can be avoided.

Furthermore, though the cooling operation is executed during the de-frosting operation, the heater 15 is driven to thereby quicken the de-frosting.

As seen from the foregoing, the dual-purpose cooling/heating air conditioner in accordance with the present invention increases the heating efficiency and capacity thereof, and the established temperatue is reached at the initial stage of operation, de-frosting is executed quickly and compressor damage can be prevented because the retrieval of oil for the compressor has been enhanced.

Specifically, various forms of the heater which is the supplemental heating means can be provided and the object of the present invention can be achieved regardless of the form of heater employed.

Furthermore, while the flow chart of the control method according to the present invention has been described in detail as one embodiment, it should be noted that the object can be obtained even though some steps of addition, omission or change of order are made therein.

What is claimed is:

1. A dual-purpose cooling/heating air conditioner comprising a compression and an evaporator located upstream of said compressor for heating refrigerant conducted from said evaporator to said compressor, supplemental heating means for heating the refrigerant after the refrigerant leaves said evaporator and before the refrigerant enters said compressor, and control means for said supplemental heating means for maintaining the refrigerant at least at a predetermined minimum superheat level before entering said compressor.

2. A dual-purpose cooling/heating air conditioner according to claim 1, further including a refrigerant accumulator disposed between said evaporator and said compressor, said supplemental heating means disposed within said accumulator.

3. A dual-purpose cooling/heating air conditioner according to claim 2, wherein said heater is an electrical resistance heater element.

4. A dual-purpose cooling/heating air conditioner according to claim 3, wherein said accumulator includes a housing having an inlet and an outlet, said outlet comprising a conduit extending into said housing, said heater element disposed within said housing and being of coil shape, said coil-shaped element extending around said conduit.

5. A dual-purpose cooling/heating air conditioner according to claim 1, wherein said control means comprises detecting means for detecting a level of refrigerant superheat downstream of said evaporator and upstream of said supplemental heating means, and means for comparing said level of refrigerant superheat with a reference value.

6. A dual-purpose cooling/heating air conditioner according to claim 5, wherein said detecting means comprises a pressure detector for detecting refrigerant pressure, and a temperature detector for detecting refrigerant temperature.

7. A dual-purpose cooling/heating air conditioner according to claim 6, wherein said control means comprises a microcomputer for calculating a saturated temperature on the basis of detected refrigerant pressure, for subtracting said saturated temperature from said detected refrigerant temperature to determine a difference therebetween, and for actuating said supplemental heating means in accordance with said difference.

8. A dual-purpose cooling/heating air conditioner according to claim 7, wherein said control means includes discharge temperature detecting means for detecting the temperature of refrigerant discharged from said compressor, and discharge pressure detecting means for detecting the pressure of refrigerant discharged from said compressor.

9. A dual-purpose cooling/heating air conditioner according to claim 8, wherein said control means further includes a compressor drive unit for deactivating said compressor in response to one of:

said detected discharge temperature exceeding a predetermined temperature, and said detected discharge pressure exceeding a predetermined pressure.

10. A method of controlling a dual-purpose cooling/heating air conditioner comprising the steps of:

A) determining a superheat level of refrigerant upstream of a compressor to which the refrigerant is being conducted, and B) heating the refrigerant in accordance with the determined superheat level to maintain the refrigerant at least at a predetermined minimum superheat level before entering said compressor.

11. A method according to claim 10, wherein step A includes:

detecting a temperature and pressure of the refrigerant, calculating a saturated temperature of the refrigerant on the basis of the detected pressure, and heating the refrigerant in accordance with a difference between said detected temperature and said calculated saturated temperature.

12. A method according to claim 10, wherein step B includes calculating a heater drive level in accordance with the determined superheat level.

13. A method according to claim 12, wherein said step of calculating a heater drive level includes:

calculating said determined superheat level as a percentage of said predetermined superheat level, and calculating the drive level of said heater in accordance with said percentage.

14. A method according to claim 13, wherein said heating step comprises supplying an alternative electrical current to an electric heater, said step of calculating a heater drive level comprising calculating a turn-on phase angle of said alternating current.

15. A method according to claim 10, wherein said heating step comprises driving a heater, and further including the step of detecting an outdoor temperature, and driving said heater and said compressor at their respective maximum operating levels when said detected outdoor temperature is lower than a predetermined temperature.

16. A method according to claim 15, wherein said predetermined temperature is an outdoor temperature at which the heating capacity and heating load correspond to one another when said compressor is operating at a maximum level.

17. A method according to claim 15 further including the steps of detecting discharge temperature and pressure of refrigerant leaving said compressor and deactivating said compressor in response to one of:

said detected discharge temperature being lower than a predetermined temperature, and said detected discharge pressure being lower than a predetermined pressure.

18. A method according to claim 15 further including the step of deactivating said compressor when said detected refrigerant temperature is higher than a predetermined temperature.

19. A method according to claim 15 further including the steps of detecting discharge temperature and discharge pressure of refrigerant leaving said compressor, and deactivating said compressor in response to one of:

said detected discharge temperature exceeding a predetermined temperature, and said detected discharge pressure exceeding a predetermined pressure.

20. A method according to claim 15, wherein said heating step comprises flowing the refrigerant into an accumulator and actuating a heater disposed in said accumulator.

* * * * *